US007071882B2

(12) United States Patent
Kuo et al.

(10) Patent No.: US 7,071,882 B2
(45) Date of Patent: Jul. 4, 2006

(54) MONOPOLE ANTENNA FOR A WIRELESS COMMUNICATION SYSTEM

(75) Inventors: Yen-Liang Kuo, Hsintien (TW); Yun-Ta Chen, Hsintien (TW)

(73) Assignee: High Tech Computer Corp., Taoyuan Hsien (TW)

( * ) Notice: Subject to any disclaimer, the term of this patent is extended or adjusted under 35 U.S.C. 154(b) by 0 days.

(21) Appl. No.: 11/125,069

(22) Filed: May 10, 2005

(65) Prior Publication Data

US 2006/0028387 A1 Feb. 9, 2006

(30) Foreign Application Priority Data

Aug. 5, 2004 (TW) ..... 93123533 A

(51) Int. Cl.
*H01Q 1/24* (2006.01)
*H01Q 1/36* (2006.01)
*H01Q 13/10* (2006.01)

(52) U.S. Cl. ..... 343/700 MS; 343/702; 343/770

(58) Field of Classification Search ..... 343/700 MS, 343/702, 770
See application file for complete search history.

(56) References Cited

U.S. PATENT DOCUMENTS

| | | | | |
|---|---|---|---|---|
| 2003/0076268 | A1* | 4/2003 | Tarvas et al. | 343/702 |
| 2003/0098813 | A1* | 5/2003 | Koskiniemi et al. | 343/702 |
| 2004/0075611 | A1* | 4/2004 | Kenoun et al. | 343/702 |
| 2005/0001772 | A1* | 1/2005 | Sugiyama et al. | 343/702 |

* cited by examiner

*Primary Examiner*—Tan Ho
(74) *Attorney, Agent, or Firm*—Rabin & Berdo, PC

(57) ABSTRACT

A miniature monopole antenna used in a wireless communication system. The monopole antenna has a radiation body, a feeding point and a short point. The radiation body has a plurality of slits alternatingly arranged at two opposite edges of the radiation body, and every slit is perpendicular to the sides of the radiation body and extends toward the inner of the radiation body. The radiation body resonates with a signal of a predetermined frequency, and is connected to the signal processing unit via the feeding point. In addition, the operational stability can be enhanced when the short point is grounded.

31 Claims, 2 Drawing Sheets

MONOPOLE ANTENNA FOR A WIRELESS COMMUNICATION SYSTEM

RELATED APPLICATIONS

The present application is based on, and claims priority from, Taiwan Application Serial Number 93123533, filed Aug. 5, 2004, the disclosure of which is hereby incorporated by reference herein in its entirety.

BACKGROUND

1. Field of Invention

The present invention relates to an antenna apparatus. More particularly, the present invention relates to a miniature monopole antenna apparatus built in a wireless communication system.

2. Description of Related Art

According to the progress of communication technology, the key development is the transfer from wired to wireless communication, such as the popularization of wireless household phones and mobile phones. In the field of wireless communication, the signal carrier is invisible air waves, where the bridge between the electrical signal and the air waves is an antenna. That is to say, an antenna is certainly needed by a wireless communication device to transmit or receive air waves. An antenna is therefore an essential component in a wireless communication device.

In the conventional wireless communication device, the antenna apparatus is usually attached to the exterior of the device, and causes a variety of problems. For example, an antenna is easily damaged by external force, and the overhead of the circuit design is rising and hard to carry. In addition, in accordance with the present design trend, many functions are integrated into a device, such as a mobile phone with the data processing function of a personal digital assistant (PDA) or a portable computer system with Bluetooth communicating function and wireless local area network (WLAN). Thus, the amount of components and antennas will substantially increase in the device, but the volume of the device must be maintained within a range. For these reason, the external antenna is increasingly unsuited to use in advanced wireless communication devices.

Ii is apparent that the miniature antenna built in the wireless communication devices will be a mainstream trend in the communications field. The conventional built-in miniature antenna techniques comprise chip antenna and planer antenna, and have some problems. For example, a chip antenna connects with a communication system via a carrier, and the relations between the dielectric constant of the carrier and the operation frequency of the antenna, and between the dielectric constant of the carrier and the performance of the antenna, all are an inverse proportion. That is to say, if the chip antenna needs a lower operation frequency, the dielectric constant of the carrier must be higher, and causes a lower performance of the chip antenna. Besides, the mounting technique used by some of built-in miniature antennas may be different from the mounting techniques used by the communication system. Thus, the antenna and the system are difficult to integrate and expensive.

SUMMARY

It is therefore an objective of the present invention to provide a built-in miniature antenna apparatus.

It is another objective of the present invention to provide a miniature antenna apparatus, which has a stable performance and is easily integrated into a wireless communication system.

It is still another objective of the present invention to provide a wireless communication device with a built-in miniature antenna, where the wireless communication device is small and easily carried.

In accordance with the foregoing and other objectives of the present invention, the invention provides a rectangular radiation body made of metal, which has a feeding point, a short point, and a plurality of threadlike slits. The slits are alternatingly arranged on opposite edges of the radiation body and perpendicularly extend to the interior of the radiation body. Due to a zigzag path formed by the slits on the radiation body, the radiation body resonates with a signal of a specific frequency. In addition, the feeding point is used to connect the radiation body and a signal processing unit, and the short point is used as a ground for enhancing the matching ability of the antenna and the operational stability thereof.

The radiation body also has many pins to allow perpendicular mounting of the radiation body on the substrate of a communication system by the identical surface mounting technique (SMT) used by the others components.

It is to be understood that both the foregoing general description and the following detailed description are by examples and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
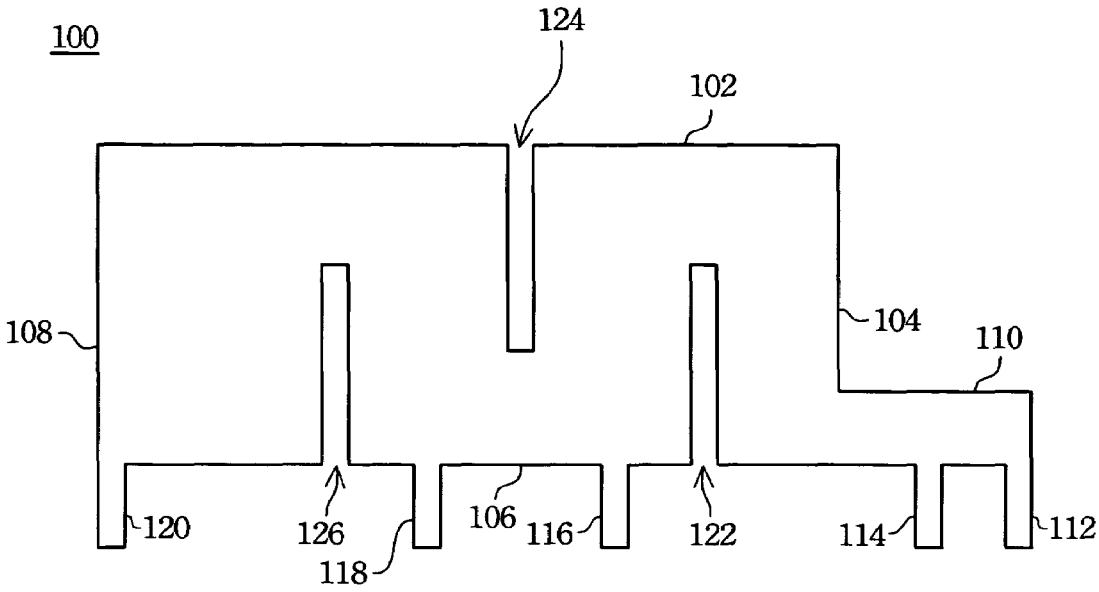
FIG. 1 illustrates the structure of a monopole antenna in accordance with an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

The basic concept of the present invention is defining a current conducting path on a antenna body made by metal for resonating with a signal has a predestinate frequency, wherein the frequency is determined by the length of the current conducting path.

FIG. 1 shows the structure of a built-in miniature monopole antenna according to an embodiment of the present invention. The body of a monopole antenna 100 comprises a rectangular region and a section 110, where the rectangular is constituted by edges 102–108 and the section 110 can be connected with any edge of the rectangular region. In the embodiment, the section 110 is extended and formed from the edge 106, and is perpendicular to the edge 104. The monopole antenna 100 is made of metal, such as nickel-plated copper. Many pins perpendicularly extend from the edge 106; these pins comprise a short point 112, a feeding point, and pins 116–120 used to fix the monopole antenna 100. In addition, many slits are alternatingly arranged at the edge 102 and the edge 106; that is, slits 122–126 in the embodiment, but the number of slits is not limited by the embodiment in practice. Slits 122–126 are perpendicular to the edge 102 or the edge 106, respectively, and all extend to the interior of the monopole antenna 100.

According to the antenna structure from the foregoing description, a zigzag path with a specific length is formed by segmenting the body of the monopole antenna 100 by slits 122–126, and the path allows the monopole antenna 100 to resonate with a signal of a specific frequency. The frequency value of the signal is determined by the length of the path, because the relation between the resonance frequency value and the length of the path is an inverse proportion. That is to say, when more slits are in the monopole antenna 100, the path is longer and the resonance frequency value is lower. Thus, the resonance frequency value can be determined by the number of slits on the monopole antenna 100.

For example, if the resonance frequency value of the monopole antenna 100 shown in FIG. 1 is to be about 2.4 GHz or 5.2 GHz, the monopole antenna 100 can be used in a Bluetooth or a wireless local area network (WLAN) communication system. Furthermore, if the monopole antenna 100 is to be uses in a communication system with a higher operation frequency, a reduction in the length of the path achieves the objective. The length of the path can be reduced by decreasing the number of slits or reducing the length of the slits. Comparatively, if the monopole antenna 100 is to be used in a communication system with a lower operation frequency, an increase in the length of the path achieves the objective. That is, the number or the length of the slits is increased.

The short point 112 can be connected to a ground potential or floated. If the short point 112 is grounded, the matching ability of the monopole antenna 110 will be enhanced, and then the operation of the monopole antenna 100 will be more stable. The pins 116–120 are floated and are used to perpendicularly fix the monopole antenna 100 on the system substrate. The number of floating pins is not limited as long as the monopole antenna 100 can be fixed.

Figure 2A:
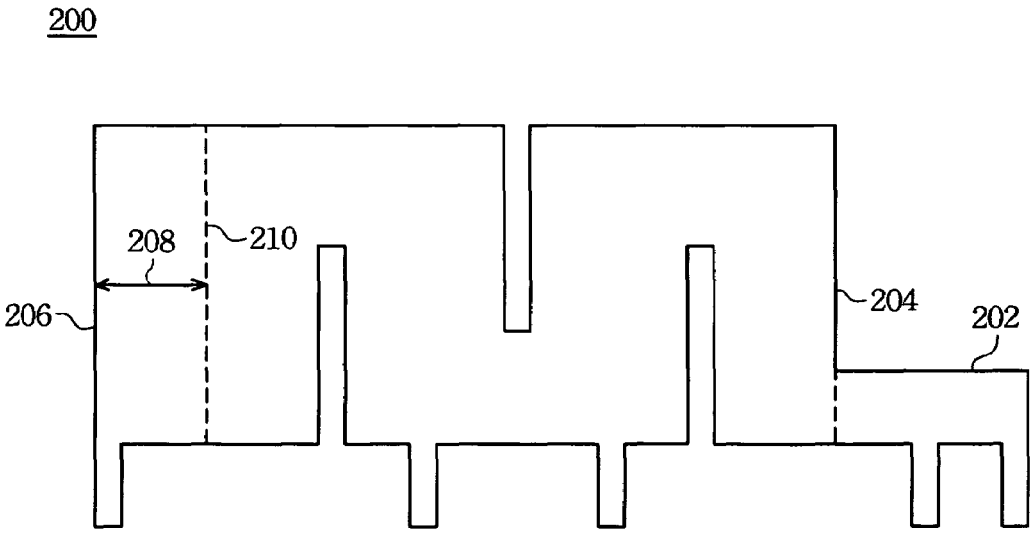
FIG. 2A illustrates the structure of a monopole antenna in accordance with an embodiment of the present invention.
Figure 2B:
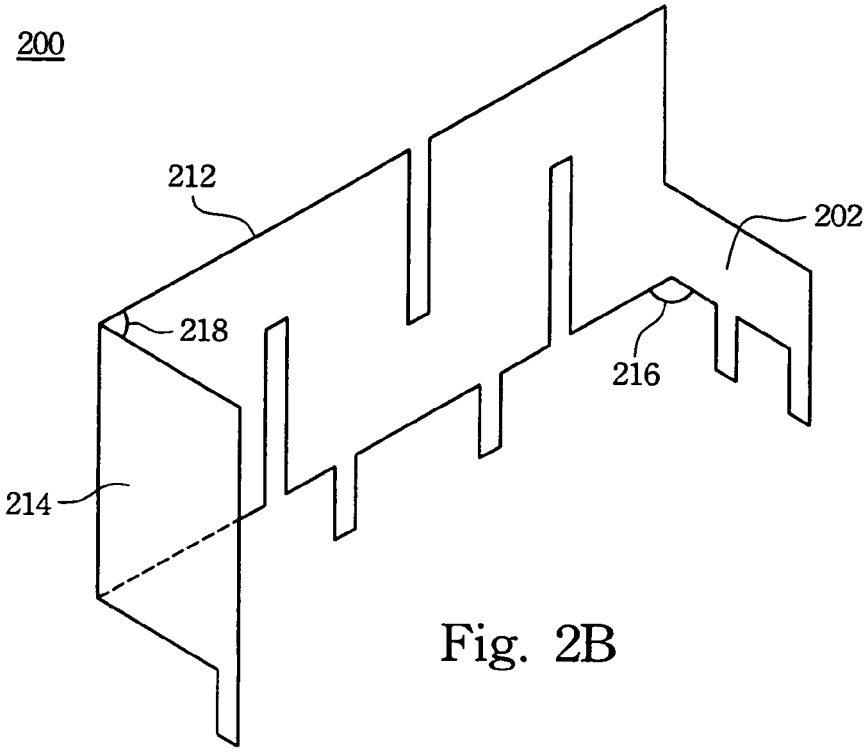
FIG. 2B illustrates the structure of a monopole antenna in accordance with an embodiment of the present invention.

Reference is made to FIG. 2A and FIG. 2B. The shape of the monopole antenna may be changed from flat to three-dimensional. For example, a monopole antenna 200 shown in FIG. 2A has the same structure and operation as the monopole antenna 100 shown in FIG. 1, and the monopole antenna 200 also can be bent into a shape shown in FIG. 2B. For this purpose, a section 202 of the monopole antenna 200 is bent along an edge 204, and the monopole antenna 200 is bent along a folding line 210 with a distance 208 from a edge 206. The bending direction of the section 202 and the monopole antenna 200 is the same and the distance 208 is approximately between the length of the section 202 and the distance between the folding line 210 and the edge 204. Referring to FIG. 2B, the bent monopole antenna 200 can be divided into three parts, comprising the section 202, a flat 212 and a flat 214. In this embodiment, the range of an angle 216 between the section 202 and the flat 212 is about 60° to 90°, and an angle 218 between the flat 212 and the flat 214 is about 90° to 120°.

Figure 2C:
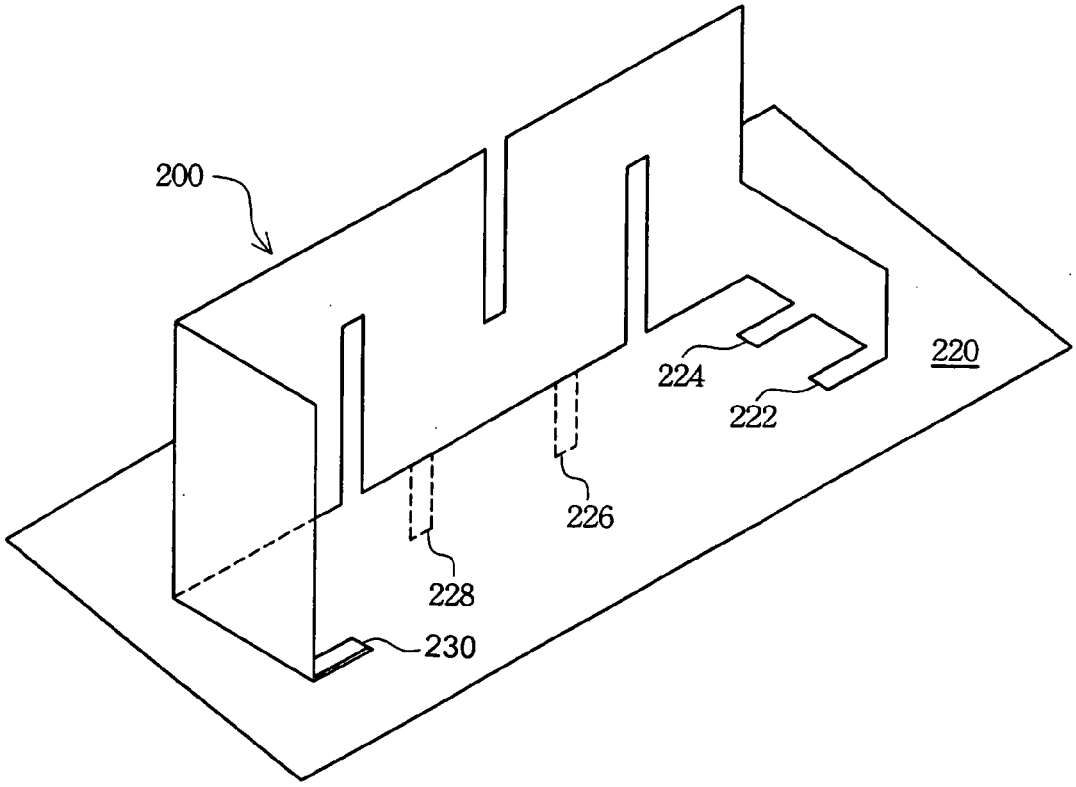
FIG. 2C illustrates the installation of a monopole antenna in accordance with an embodiment of the present invention.

FIG. 2C shows the installation of the monopole 200 on a substrate 220, where the substrate 220 is a general circuit board used in a circuit system, such as an isolated region in a printed circuit board (PCB). The monopole antenna 200 is perpendicularly installed on the substrate 220; that is to say, the section 202, flat 212 and flat 214 shown in FIG. 2B all are perpendicular to the substrate 220. Then, any fixing technique used in the circuit board field may be used to fix a short point 222, a feeding point 224 and pins 226–230. In this embodiment, the short point 222, feeding point 224 and pin 230 is bent to the inside and then fixed on the surface of the substrate 220 by a surface mounting technique (SMT). Furthermore, the pins 226 and 228 are buried in the substrate 220 at first, and then are fixed. Different fixing techniques may be used to fix these pins for different applications, and the embodiment is not to be construed as a limitation on the scope of the invention.

After the monopole antenna 200 is fixed, the pins 226–230 can be kept floating. The feeding point 224 is connected with a radio frequency (RF) component (not shown) of a wireless communication system, such as a mobile phone or PDA system with a Bluetooth or WLAN function, for signal communication. Thus, the monopole antenna 200 is integrated with the communication system. Furthermore, the short point 222 may be kept floating or grounded. If the short point 222 is grounded, the matching ability of the monopole antenna 200 can be enhanced, and the operation of the monopole antenna 200 can also be more stable. The connections between the components referred herein can be formed by any wiring technique used in a circuit board.

According to the foregoing description, the monopole antenna of the present invention has many characteristics, such as simple material, low cost high performance and ease of integration. According to the description of the embodiment of the present invention, the monopole antenna is formed from sheet metal to avoid material that is complicated or hard to acquire, thus reducing the cost of the wireless communication system. However, the monopole antenna still keeps the operational performance at a level. Compared with conventional chip antennas, the monopole antenna of the present invention can be installed without any carrier; therefore, the performance of the antenna will not be degraded by the effect of the carrier. On the whole, the monopole antenna of the present invention is evidently better than the chip antenna in the aspects of power consumption and sensitivity. In addition, the monopole antenna of the present invention can be easily integrated with the whole system, because the monopole antenna of the present invention has a smaller volume and only fixing and wiring techniques used in the general circuit board, such as PCB, are needed. For example, if the monopole antenna shown in FIG. 2C is designed to be used in the band of 2.4 GHz, the size thereof may only be 9.5×4.5×4.3 mm. Similarly, if the monopole antenna is designed to be used in a higher band, the size thereof will smaller; that is to say, the length thereof will not be more than 10 mm, and the monopole antenna is well suited to be used in a small system.

When a monopole antenna of the present invention starts to be integrated with a system where a PCB is to be used as a substrate, an isolated region for placement of the monopole antenna is first planed on the circuit board. Then, the monopole antenna is fixed on the isolated region in the circuit board by the same SMT used to fix the other components, such as integrated circuits or passive devices, on the circuit board. Finally, the monopole antenna can be connected to the other components in the system by a general wiring technique of PCB.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A miniature monopole antenna apparatus, comprising:

a rectangular sheet metal constituted by four edges, wherein said rectangular sheet metal comprises a plurality of slits alternatingly formed from two opposite edges of said four edges;

a section perpendicularly extending from one of said four edges;

a feeding point located in said section; and a plurality of pins located at one of said four edges.

2. The miniature monopole antenna apparatus of claim 1, further comprising a short point located in said section.

3. The miniature monopole antenna apparatus of claim 1, wherein the whole of said miniature monopole antenna apparatus is made of metal.

4. The miniature monopole antenna apparatus of claim 3, wherein said metal is nickel-plated copper.

5. The miniature monopole antenna apparatus of claim 1, wherein the slits in said plurality of slits are parallel to each other.

6. The miniature monopole antenna apparatus of claim 1, wherein said miniature monopole antenna apparatus resonates with a signal having a frequency of about 2.4 GHz or 5.2 GHz.

7. The miniature monopole antenna apparatus of claim 1, wherein an angle between said rectangular sheet metal and said section is about 60° to 90°.

8. The miniature monopole antenna apparatus of claim 1, further comprising a rectangular flat connected with one of said four edges opposite a position of said section.

9. The miniature monopole antenna apparatus of claim 8, wherein an angle between said rectangular sheet metal and said rectangular flat is about 90° to 120°.

10. The miniature monopole antenna apparatus of claim 1, wherein a length of a whole of said miniature monopole antenna apparatus is less than about 10 mm.

11. A miniature monopole antenna apparatus, comprising:

a rectangular sheet metal constituted by a first edge, a second edge, a third edge, and a fourth edge, wherein said rectangular sheet metal comprises a plurality of slits alternatingly formed from said first edge and said third edge;

a section perpendicularly extending from said second edge, wherein a first angle is formed between said section and said rectangular sheet metal;

a rectangular flat connected with said fourth edge, wherein a second angle is formed between said rectangular flat and said rectangular sheet metal;

a feeding point located in said section; and a plurality of pins located at said third edge and one edge of said rectangular flat.

12. The miniature monopole antenna apparatus of claim 11, further comprising a short point located in said section.

13. The miniature monopole antenna apparatus of claim 11, wherein the whole of said miniature monopole antenna apparatus is made of metal.

14. The miniature monopole antenna apparatus of claim 13, wherein said metal is nickel-plated copper.

15. The miniature monopole antenna apparatus of claim 11, wherein the slits in said plurality of slits are parallel to each other.

16. The miniature monopole antenna apparatus of claim 11, wherein said miniature monopole antenna apparatus resonates with a signal having a frequency of about 2.4 GHz or 5.2 GHz.

17. The miniature monopole antenna apparatus of claim 11, wherein said first angle is about 60° to 90°.

18. The miniature monopole antenna apparatus of claim 11, wherein said second angle is about 90° to 120°.

19. The miniature monopole antenna apparatus of claim 11, wherein a length of a whole of said miniature monopole antenna apparatus is less than about 10 mm.

20. A wireless communication system, comprising:

a signal processing unit, wherein said signal processing unit comprises a radio frequency (RF) component;

a miniature monopole antenna apparatus, comprising:

a rectangular sheet metal constituted by a first edge, a second edge, a third edge, and a fourth edge, wherein said rectangular sheet metal comprises a plurality of slits alternatingly formed from said first edge and said third edge;

a section perpendicularly extending from said second edge, wherein a first angle is formed between said section and said rectangular sheet metal;

a rectangular flat connected with said fourth edge, wherein a second angle is formed between said rectangular flat and said rectangular sheet metal;

a feeding point located at said section, wherein said feeding point is used to connect with said radio frequency component of said signal processing unit; and a plurality of pins located at said third edge and one edge of said rectangular flat.

21. The wireless communication system of claim 20, further comprising a short point located at said section and used as a ground.

22. The wireless communication system of claim 20, wherein a whole of said miniature monopole antenna apparatus is made of metal.

23. The wireless communication system of claim 22, wherein said metal is nickel-plated copper.

24. The wireless communication system of claim 20, wherein the in the slits in said plurality of slits are parallel to each other.

25. The wireless communication system of claim 20, wherein said miniature monopole antenna apparatus resonates with a signal having a frequency of about 2.4 GHz or 5.2 GHz.

26. The wireless communication system of claim 20, wherein said first angle is about 60° to 90°.

27. The wireless communication system of claim 20, wherein said second angle is about 90° to 120°.

28. The wireless communication system of claim 20, wherein a length of a whole of said miniature monopole antenna apparatus is less than about 10 mm.

29. The wireless communication system of claim 20, wherein said wireless communication system is a Bluetooth communication system or a wireless area network (WLAN) system.

30. The wireless communication system of claim 20, further comprising a system circuit board, wherein said miniature monopole antenna apparatus is fixed on said system circuit board by a general surface mounting technique (SMT).

31. The wireless communication system of claim 30, wherein said system circuit board is a printed circuit board (PCB).

* * * * *